United States Patent [19]

Mobley et al.

[11] Patent Number: 4,971,579

[45] Date of Patent: Nov. 20, 1990

[54] ELECTRICAL CONNECTOR WITH REMOVABLE TERMINAL GUIDE AND LOCK

[75] Inventors: Dewey F. Mobley, Lake Orion; August Barbrick, Plymouth, both of Mich.

[73] Assignee: Interlock Corporation, Westland, Mich.

[21] Appl. No.: 437,281

[22] Filed: Nov. 15, 1989

Related U.S. Application Data

[63] Continuation of Ser. No. 257,533, Oct. 14, 1988, abandoned.

[51] Int. Cl.[5] ..... H01R 13/40

[52] U.S. Cl. ..... 439/595; 439/592

[58] Field of Search ..... 439/592, 595

[56] References Cited

U.S. PATENT DOCUMENTS

| | | | |
|---|---|---|---|
| 4,253,718 | 3/1981 | Bungo | 439/595 |
| 4,431,252 | 2/1984 | Cairns et al. | 439/595 |
| 4,557,542 | 12/1985 | Caller et al. | 439/595 |
| 4,565,416 | 1/1986 | Rudy et al. | 439/592 |
| 4,714,437 | 12/1987 | Dyki | 439/595 |
| 4,750,893 | 6/1988 | Sueyoshi et al. | 439/596 |
| 4,753,612 | 6/1988 | Betsui | 439/596 |
| 4,784,617 | 11/1988 | Oda | 439/595 |
| 4,797,116 | 1/1989 | Isahata et al. | 439/595 |
| 4,820,198 | 4/1989 | Lulko et al. | 439/595 |
| 4,867,705 | 9/1989 | Yuasa | 439/596 |

FOREIGN PATENT DOCUMENTS

| | | | |
|---|---|---|---|
| 2704760 | 8/1977 | Fed. Rep. of Germany | 439/595 |

*Primary Examiner*—Paula A. Bradley

*Attorney, Agent, or Firm*—Harness, Dickey & Pierce

[57] ABSTRACT

An improved electrical connector assembly having deflectable retaining fingers for mating with a corresponding connector assembly. Each assembly has at least one electrical terminal housed inside a hollow body adapted to enclose and support the terminal. The body has a separate passage intersecting the cavity in which the terminal resides. In addition, the hollow body has at least one wall section having a deflectable finger engaging and retaining the terminal within the cavity. A removable terminal retainer member is inserted into the passage to a position in which the member is in an interference relation with a portion of the terminal to retain the terminal within the cavity. The terminal retainer also has a wedge leg that, when inserted against the wall section, retains the deflectable finger in engagement with the terminal.

11 Claims, 3 Drawing Sheets

ELECTRICAL CONNECTOR WITH REMOVABLE TERMINAL GUIDE AND LOCK

This is a continuation application Ser. No. 07/257,533, filed Oct. 14, 1988, now abandoned.

BACKGROUND AND SUMMARY OF THE INVENTION

This invention relates generally to mating male and female insulated electrical connector assemblies and more particularly to electrical connector assemblies for multiple male and female terminals.

Various insulated connector assemblies have been designed for engaging, enclosing and supporting male and female terminals. Some connector assembly bodies have an internally projecting shoulder which engages and retains the terminal in position.

One such assembly is disclosed in U.S. patent application Ser. No. 107,681, filed Oct. 13, 1987, Now U.S. Pat. No. 4,813,889 and assigned to the assignee of this application. This connector has a deflectable finger formed between two slits in one wall section of the hollow body of the connector. The finger has an internally projecting shoulder which engages the inserted terminal to retain the terminal within the connector body. When the connectors are unmated the finger can be deflected, without the use of special tools, out of engagement with the terminal to permit the terminal to be withdrawn from the connector body to allow visible inspection of the terminal and the connector body components.

It is an object of the present invention to provide an improved connector assembly having deflectable fingers and a removable retainer that maintains the deflectable fingers in engagement with the terminals inserted into the connector body.

It is another object of the present invention to provide an improved connector assembly having a secondary lock mechanism to retain the electrical terminals within the body of the connector.

It is another object of the present invention to provide an improved connector assembly capable of withstanding substantial pull out force without releasing a terminal from the assembled connector or shearing shoulders from the deflectable fingers.

It is a further object of the present invention to provide an improved connector assembly having a removable lock with a guide to direct insertion of male terminals into the female terminals when mating connectors are joined.

It is a still further object of the present invention to provide an improved connector assembly which cannot be unlocked to permit terminal removal until the connectors are disengaged.

It is a still further object of the present invention to provide a connector assembly having an indicator which confirms correct terminal alignment within the connector body.

It is a still further object of the present invention to provide an improved connector assembly a unitary guide member insertable within the connector body which guides the insertion of male terminals, wedges the deflectable fingers into engagement with inserted terminals, and provides the secondary lock to retain the terminals within the body of the connector.

The improved electrical terminal connector assembly according to the present invention for housing either a female or a male terminal has a hollow body having at least one terminal cavity adapted to enclose and support the terminal The connector body preferably has at least one straight row of aligned cavities adjacent one another to house several aligned terminals. The hollow body has at least one wall section defining one wall of each cavity having two spaced apart slots forming between them a deflectable finger cantilever supported at one end by the wall.

The deflectable finger has an inwardly projecting shoulder portion which resiliently engages the electrical terminal inserted into the cavity when the terminal is fully inserted. The deflectable finger is pushed outward as the terminal is inserted and then snaps into engagement with the terminal as the terminal reaches the fully inserted position within the cavity.

A separate terminal retainer and guide member is removably inserted into the body to retain and lock the terminal within the cavity and hold the deflectable finger in retaining engagement with the terminal in the cavity. The retainer and guide member includes an elongated insert which is slidably disposed in a separate passage in the hollow body which passes transversely through a portion of the terminal cavity.

When the elongated insert is inserted in the passage, it engages a portion of the terminal enclosed within the cavity to retain the terminal in place. If the terminal is not fully seated within the cavity, the elongated insert will not be able to pass through the passage to a fully inserted position. This then provides an indication of whether or not the terminals are fully and properly seated within the connector body.

The elongation insert has at least two elongated legs, one of which is inserted in the passage. The other leg is positioned outside the cavity wall against the deflectable finger preventing the deflectable finger from being deflected out of engagement with the terminal in the cavity.

A preferred embodiment of the connector assembly includes two rows of multiple aligned terminals and cavities side by side. Therefore the retainer and guide member has two parallel elongated insert legs designed to pass within two corresponding parallel passages in the hollow connector body, one passage through each row of cavities. A third leg is positioned outside and between the rows of the cavities against the deflectable fingers preventing disengagement of the fingers with the terminals.

One preferred embodiment of the present invention is particularly adapted for retaining female terminals within the connector body. This embodiment includes one of the elongated legs of the insert having a generally flat guide portion forming part of each cavity entrance for directing insertion of the corresponding male terminal into the female terminal as the corresponding connectors are mated.

The elongated leg of the insert which is positioned outside the cavity against the deflectable finger includes a notched projection which is engagable with a portion of the connector body to retain the retaining guide member in the fully inserted position This leg is resiliently biased toward the other leg so that the insert snap fits into the fully inserted position.

In addition, when the insert is fully inserted into the connector body and the connector bodies are mated, the retainer and guide member is locked into place. Coaction between the mated connectors prevent disengagement of the insert from the connector body.

Other objects, features and advantages of the present invention will become apparent from a consideration of the following description and the appended claims when taken in connection with the accompanying drawings.

DETAILED DESCRIPTION OF THE PREFERRED EMBODIMENT

Figure 1:
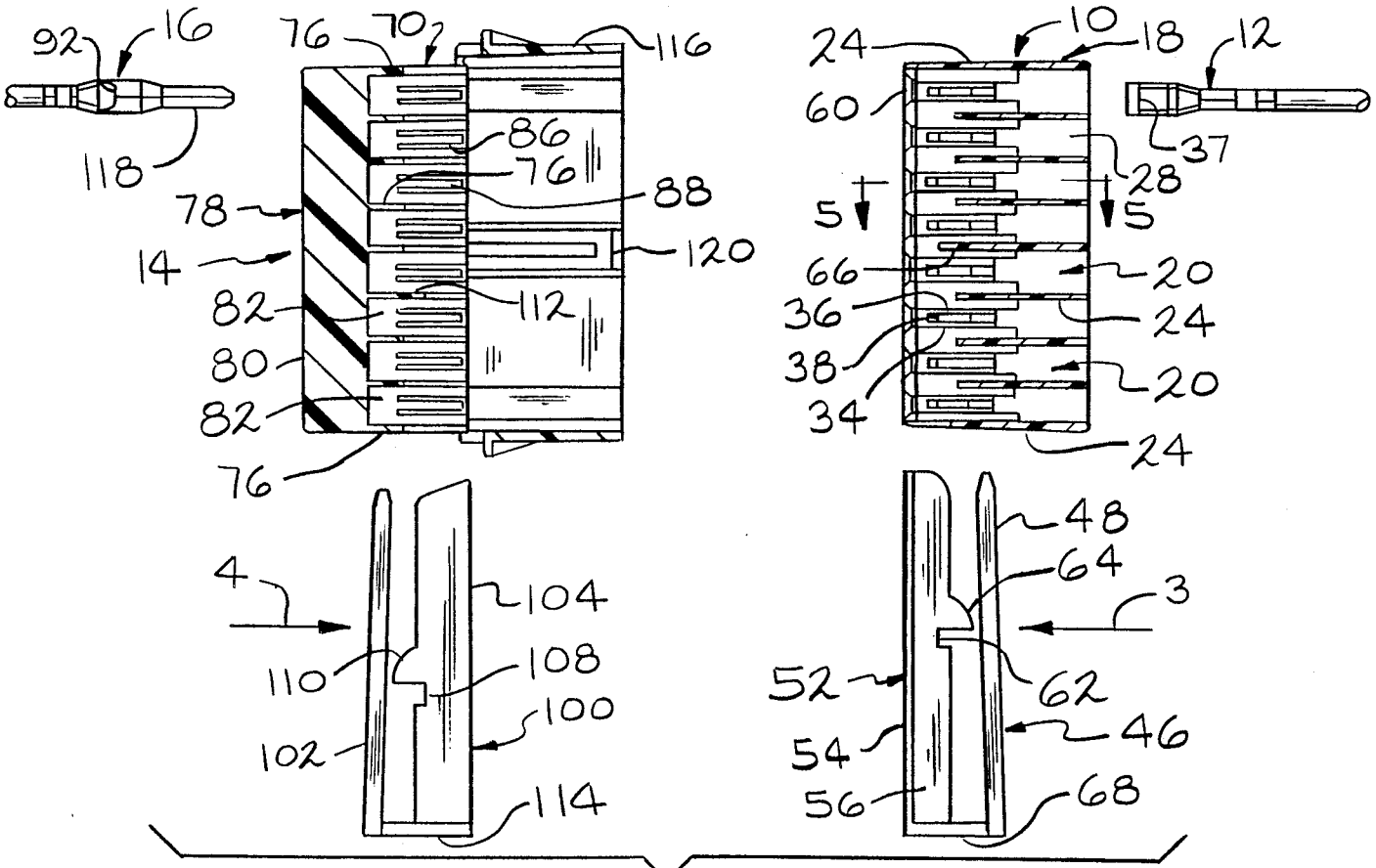
FIG. 1 is an exploded view of the improved corresponding male and female connector assemblies in accordance with the present invention with the connector bodies shown in section taken along the line 1—1 of FIGS. 2 and 5.
Figure 2:
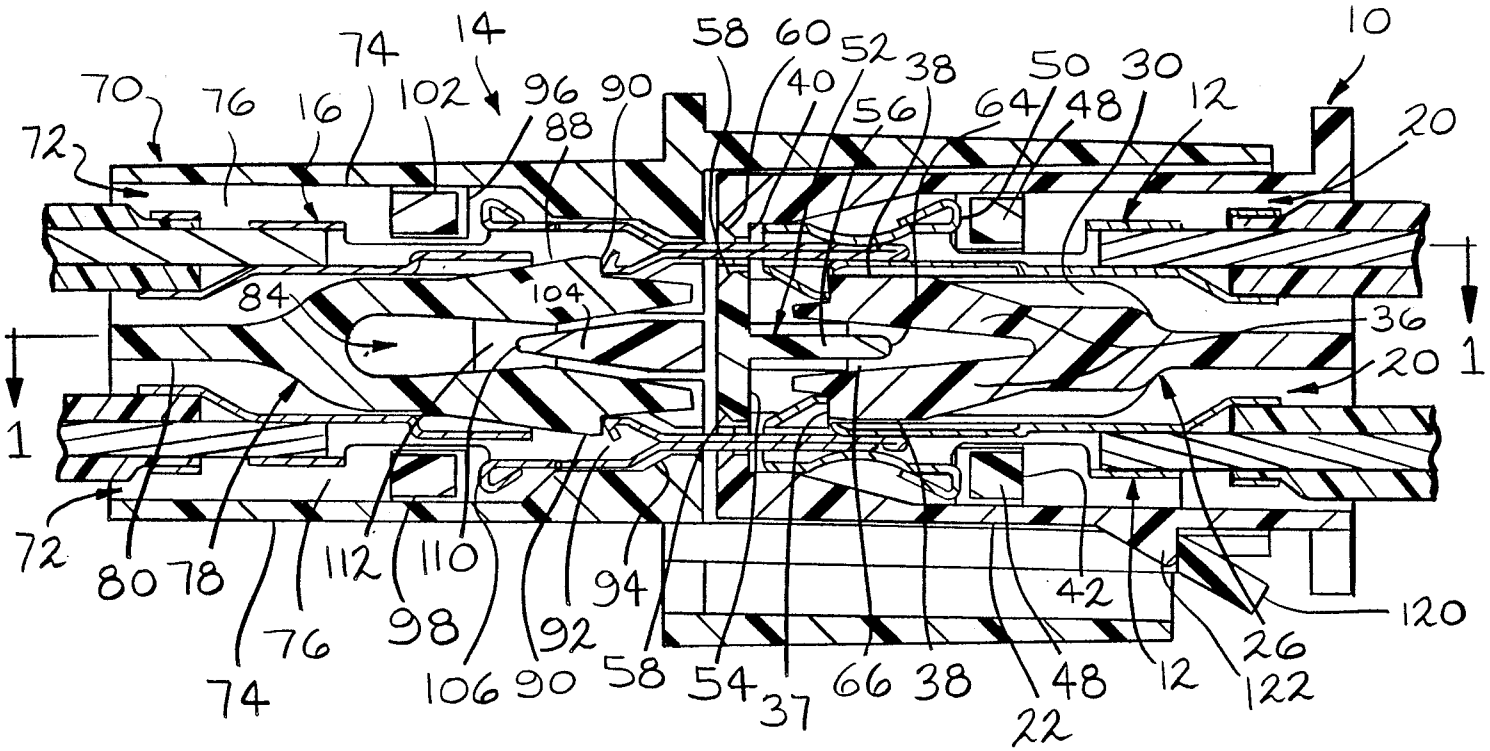
FIG. 2 is a sectional view of the assembled and mated connector assemblies of FIG. 1.

An exploded view of a Pair of corresponding male and female connector assemblies according to the present invention is shown in FIG. 1. The female terminal connector assembly 10 houses a plurality of female terminals 12 and is insertable within a male terminal connector assembly 14 as shown in FIG. 2. The male terminal connector assembly 14 houses a like number of male terminals 16, only one of which is illustrated for clarity.

Female terminal connector assembly 10 is comprised of a hollow body 18 having two aligned straight rows of eight open ended terminal cavities 20 back to back which extend through the hollow body 18. The hollow body 18 has a pair of generally flat, Parallel side walls 22, a plurality of transverse walls 24 between the side walls 22, and central wall 26 parallel to and centered between the side walls 22 joining the transverse walls 24 forming the aligned rows of open ended cavities 20.

Figure 5:
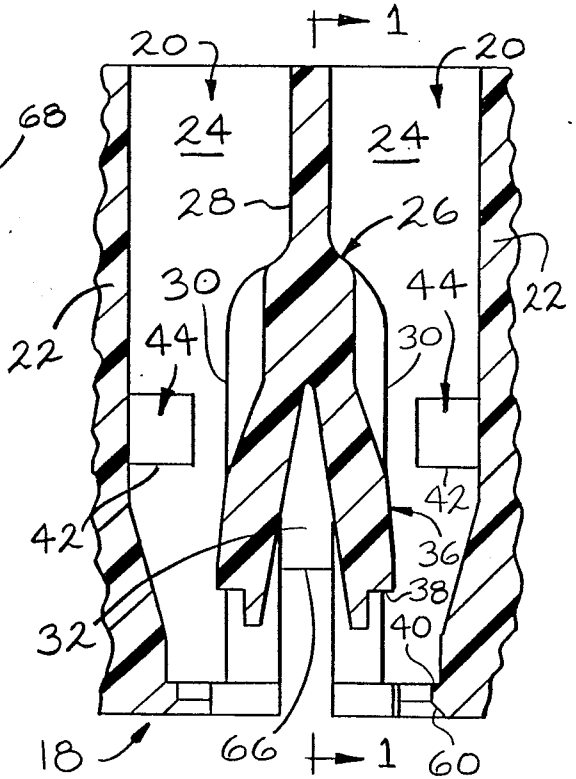
FIG. 5 is an enlarged fragmentary view of the female terminal connector body.
Figure 3:
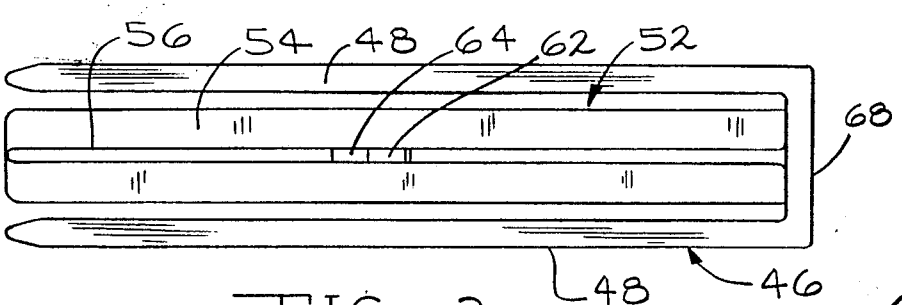
FIG. 3 is an enlarged side view of the retaining guide member for the female terminal connector as viewed from the direction of arrow 3 in FIG. 1.

As shown in FIGS. 2 and 5, central wall 26 has a common base 28 which splits into two generally, parallel spaced wall portions 30 forming a U-shaped channel 32 between them. Thus each cavity 20 has four cavity walls formed by at least part of one of the sidewalls 22, two of the transverse walls 24, and central wall 26 comprising part of common base 28 and one of the two wall portions 30.

The central wall portions 30 forming one wall of each cavity 20 each have a pair of slits 34 through the wall portion 30 forming a cantilevered deflectable finger 36 between each pair of slits. Each deflectable finger 36 is resiliently biased in parallel position to adjacent central wall portions 30. An inwardly directed shoulder 38 projects into the cavity from the mid portion of each deflectable finger 36. This shoulder 38 on deflectable finger 36 engages a corresponding recess 37 in female terminal 12 when female terminal 12 is inserted into the terminal cavity 20 and butted against fixed inwardly directed shoulders 40 formed at the end of each cavity 20 in walls 22, 24, and 30.

The inwardly directed shoulder 38 on the deflectable finger 36 engages the recess 37 in the female terminal 12 when the female terminal 12 is fully inserted within the cavity 20. This shoulder 38 on the deflectable finger 36 prevents withdrawal of the female terminal 12 from the cavity 20 unless the deflectable finger 36 is deflected out of engagement with the recess 37 in the female terminal 12. A fully inserted terminal 12 is thus retained in correct position by fixed shoulders 40 and shoulder 38 on deflectable finger 36.

Hollow body 18 has a plurality of aligned apertures 42 through transverse walls 24 which form a passage 44 through each row of cavities 20. A terminal retainer and guide insert 46 is inserted into the two passages 44 after all of the female terminals 12 have been inserted and fully seated inside the cavities 20.

This terminal retainer and guide insert 46 has a spaced pair of elongated retainer legs 48 which fit into the passages 44. Legs 48 engage the rear of each female terminal 12 inserted in a cavity 20 to secondarily retain each terminal 12 in place. The retainer legs 48 engage a flange 50 formed in the rear of each terminal 12 thus locking the terminal 12 in the fully inserted position If the terminal 12 is not fully inserted, part of the terminal 12 will block part of passage 44 preventing the full insertion of the legs 48 of the terminal retainer and guide insert 46. Therefore insert 46 acts as an indicator of whether or not all terminals are fully inserted during connector assembly.

Another leg 52 of the retainer and guide insert 46 is positioned in the U-shaped channel 32 formed between back to back wall portions 30. This leg 52 has a narrow T-shaped cross section forming a guide portion 54 and a wedge portion 56. The wedge portion 56 rides in the channel 32 between back to back wall portions 30 and prevents outward deflection of the deflectable fingers 36. This prevents disengagement of the shoulders 38 from the recesses 37 in each of the terminals 12, thus firmly wedging shoulders 38 into engagement with the terminals 12.

The flat guide portion 54 of insert 46 rides over and covers the ends of the deflectable fingers 36 and prevents access to the deflectable fingers 36 when the retainer and guide insert 46 is fully inserted and the connector assemblies are unmated. The flat guide portion 54 also guides insertion of male terminals 16. The guide portion 54 has slanted outer edges 58 which helps to guide the insertion of the male terminals when the female connector assembly 10 is mated with male terminal connector assembly 14. Edges 58 slant toward the entrance to the cavities 20. Corresponding slanting inner edges 60 on the ends of walls 22 and 24 cooperate to guide or funnel the male terminals 16 into the corresponding cavities 20.

The wedge portion 56 of leg 52 has a notch 62 and an adjacent downwardly projecting lip 64 on the wedge portion 56 spaced about midway from one end of insert 46.

The notch 62 and lip 64 are designed to engage wall 66 which is one of the transverse walls 24 extending between the side walls 22 separating the pairs of cavities 20. Wall 66 extends further than the other walls 24 as shown in FIG. 1.

When insert 46 is fully inserted in hollow body 18, notch 62 and lip 64 snap over and coact with wall 66 to retain insert 46 in position. As shown in FIG. 2, insert 46 is wedged in place when the connector assemblies 10 and 14 are mated. Thus insert 46 cannot be removed while the assemblies are mated. Therefore insert 46 is locked in place.

Retainer legs 48 and 52 are elongated members which are joined at one end by base portion 68. Legs 48 are cantilever supported by base portion 68 and resiliently canted toward leg 54.

Thus as insert 46 is installed in the body 18, the legs 48 and 52 become separated, biasing them toward one another. The lip 64 on wedge portion 56 pushes wedge portion 56 outward during insertion of insert 46, further biasing leg 52 outward until lip 64 snaps over wall 66 engaging notch 62 with wall 66 when insert 46 is fully seated in the body 18.

The pullout force necessary to forcibly withdrawal the terminal 12 from the hollow body 18 shearing the shoulder 38 from the deflectable finger 36 is on the order of ten to twenty foot pounds if shoulder 38 is the only element holding terminal 12 in place within the cavity 20. However, the addition of the retaining leg 48 abutting the flange 50 of the terminal 12 to secondarily lock it in place increases the pullout force required to approximately six times this value. Thus the terminal retainer and guide insert 46 substantially improves the terminal retention capability of the connector assembly.

The male terminal connector 14 is comprised of a hollow body 70, similar to hollow body 18 in the female terminal connector assembly 10, having two aligned straight rows of eight terminal cavities 72 which are back to back and which extend through hollow body 70.

The hollow body 70 has generally flat parallel exterior side walls 74, a plurality of transverse walls 76 between the side walls 74, and a central wall 78 Parallel to and centered between the side walls 74 and joining the transvere walls 76 forming the aligned rows of pairs of cavities 72. The central wall 78 has a common base portion 80 which splits into two generally parallel, spaced wall portions 82 forming a channel 84 between them. Thus each cavity 72 has four cavity walls formed by at least a part of one of the side walls 74, two of the transverse walls 76, and central wall 78 comprising part of the common base portion 80 and one of the two wall portions 82.

The U-shaped channel 84 cuts transversely across connector 14 and separates the two rows of terminal cavities 72 produced by the alignment of pairs of terminal cavities 72 forming hollow body 70. The central wall portion 82 forming one wall of each cavity 72 each has a pair of slits 86 through the wall portion 82 forming a cantilever supported deflectable finger 88 between each pair of slits 86. Each deflectable finger 88 is resiliently biased in a parallel position to adjacent central wall portion 82. An inwardly directed shoulder 90 projects into the cavity from the midportion of each deflectable finger 88. This shoulder 90 on deflectable finger 88 engages a corresponding recess 92 in male terminal 16 when male terminal 16 is inserted into the terminal cavity 72. The inwardly directed shoulder 90 on the deflectable finger 88 engages the recess 92 in the male terminal 16 to prevent withdrawal of the terminal from the cavity 72 unless the deflectable finger 88 is deflected out of engagement with the recess 92 in the male terminal 16.

Male terminal 16 also can be butted against inwardly directed fixed shoulders 94 formed at the end of each cavity 72 in walls 74, 76, and 78 to limit the insertion of the male terminal A fully inserted terminal 16 is thus held in correct position by fixed shoulders 94 and shoulders 90 on deflectable finger 88 in a similar fashion as female terminal 12 is held within terminal cavity 20 in female connector 10.

Similar to the construction of the female connector body 18, a plurality of aligned apertures 96 through transverse walls 76 form a passage 98 through each row of cavities 72 in hollow body 70.

Figure 4:
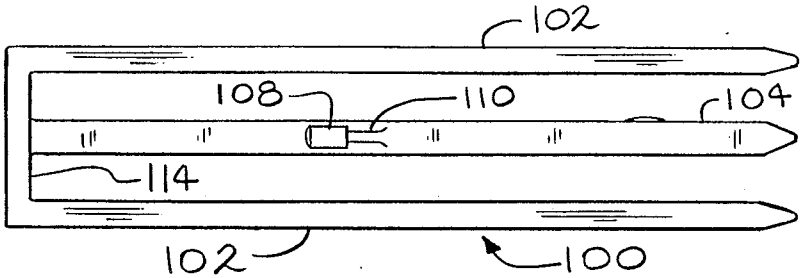
FIG. 4 is an enlarged side view of the retaining member for the male terminal connector as viewed from the direction of arrow 4 in FIG. 1.

A terminal retainer 100, shown in FIGS. 1 and 4, is similar in construction to the terminal retainer and guide insert 46 but without the guide portion 54. This terminal retainer 100 has a spaced pair of retaining legs 102 and a wedge shaped leg 104, legs 102 fit into the passages 98 engaging a flange 106 at the rear of each male terminal 16 inserted in the cavity 72 to secondarily retain each terminal 16 in place.

Similar to the operation of the female connector assembly 10 described above, if one of the terminals 16 is not fully inserted within its terminal cavity 72, Part of the terminal 16 blocks part of passage 98 preventing the full insertion of the terminal retainer 100. Therefore terminal retainer 100 indicates whether or not all male terminals are fully inserted during connector assembly.

The wedge shaped leg 104 of the terminal retainer 100 is positioned in the U-shaped channel 84 formed between back to back wall portions 82. This wedged leg 104 prevents outward deflection of the deflectable fingers 88 to prevent the disengagement of the shoulders 90 from the recesses 92 in each of the terminals 16, thus firmly wedging shoulders 90 into engagement with the terminals 16.

The wedge leg 104 includes a notch 108 adjacent downwardly projecting lip 110 spaced about midway from one end of the terminal retainer 100. The notch 108 and the lip 110 are designed to engage a transverse wall 112 which is one of the transverse walls 76 extending between the side walls 74 separating the pairs of terminal cavities 72. Transverse wall 112 extends outward further than the other walls 76 as shown in FIG. 1.

When terminal retainer 100 is fully inserted in hollow body 70, notch 108 and lip 110 snap over wall 112 to retain terminal retainer 100 in position. As shown in FIG. 2, terminal retainer 100 is wedged in place when the connector assemblies 10 and 14 are mated. Thus terminal retainer 100 cannot be removed while the assemblies are mated together.

Retaining legs 102 and wedge leg 104 are elongated members which are joined at one end to a flat base portion 114. Retaining legs 102 are cantilever supported from base portion 114 and resiliently inclined toward wedge leg 104. Thus as terminal retainer 100 is installed in the body 70, legs 102 and 104 become separated, biasing toward one another. The lip 110 on wedge leg 104 pushes the wedge leg 104 outward as terminal retainer 100 is inserted Further insertion of terminal retainer 100 causes further deflection of wedge leg 104 outward until lip 110 snaps over wall 112 engaging notch 108 when terminal retainer 100 is fully seated in the hollow body 70. When terminal retainer 100 is fully seated, this indicates that all male terminals 16 are also fully inserted.

Hollow body 70 also includes a shroud portion 116 extending outward from and generally parallel to side walls 74. Shroud portion 116 protects the protruding blades 118 of male terminals 16 when they are inserted within the terminal cavity 72. In addition, shroud portion 116 guides and aligns the insertion of the female terminal connector assembly 10 into proper alignment between female terminals 12 and male terminals 16 as the connectors 10 and 14 are joined. In addition, a latch 120 on shroud portion 116 coacts with an outwardly projecting shoulder 122 projecting outward from one of the exterior side walls 22 of female terminal connector assembly 10 when the assemblies are fully mated. The latch 120 retains the mated male and female terminal connector assemblies 14 and 10 respectively together as illustrated in FIG. 2.

The connector assemblies according to the present invention have teen described in an illustrative manner and it is to be understood that the terminology which has been used is intended to be in the nature of words of description rather than of limitation. Obviously many modifications and variations of the present invention are possible in light of the above teachings. It is, therefore to be understood that within the scope of the appended claims, the invention may be practiced otherwise than as sPecifically described.

What is claimed is:

1. An electrical connector assembly comprising at least one electrical terminal, a hollow body having at least one terminal cavity, said cavity defining a longitudinal terminal insertion axis therein and adapted to enclose and support said electrical terminal, said body also including at least one wall section defining one wall of said cavity, said wall including deflectable means for engaging and retaining said electrical terminal within said cavity and means for maintaining said deflectable means in retaining engagement with said electrical terminal in said cavity, said body having a separate passage therein intersecting said cavity, said passage defining a terminal retainer insertion axis being traverse to said terminal insertion axis, a terminal retainer having at least two elongated legs, one of said legs being removably inserted in said passage in said body to a position in which said leg is in an interference relationship with a portion of said terminal thereby retaining said terminal within said cavity, another of said legs being positioned outside said cavity against said one wall preventing said deflectable means from being deflected out of retaining engagement with said terminal in said cavity.

2. The assembly according to claim 1 further comprising locking means for preventing removal of said retainer means from said body when said connector assembly is mated with said corresponding connector assembly.

3. The assembly according to claim 2 wherein said locking means comprises a projection on one of said legs of said member engagable with said body, said legs being deflectably biased toward one another and into engagement with said body when inserted therein, said projection and said body coacting to prevent removal of said insert from said body.

4. The assembly according to claim 3 wherein said leg having said projection thereon engages said corresponding connector assembly when said connector assemblies are mated so as to prevent said projection from being deflected out of engagement with said body thereby locking said member within said body.

5. A connector assembly having a female terminal therein for mating with a male terminal, said female connector assembly comprising:

a hollow body having at least one terminal cavity, said cavity defining a longitudinal axis of insertion and adapted to enclose and support a female terminal; and a terminal retainer and guide means removably positioned in said body in transverse relation to said longitudinal axis of insertion, for retaining said female terminal within said cavity and forming a guide to direct said male terminal into said female terminal.

6. The female terminal connector assembly according to claim 5 wherein said body has a separate passage therein intersecting said cavity, and said retaining and guide means further comprises an elongated leg slidably disposed in said passage in said body in a position in which said leg is in an interference relationship with a portion of said female terminal enclosed within said cavity retaining said terminal therein.

7. The connector assembly according to claim 5 wherein said retainer and guide means has a generally flat guide portion outside of and adjacent to one end of said cavity for directing said male terminal into said female terminal as said terminals are mated.

8. The connector assembly according to claim 7 further comprising locking means for preventing removal of said retainer and guide means from said body when said connector assembly is mated with a corresponding connector assembly.

9. The connector assembly according to claim 8 wherein said locking means comprises a projection on said retainer and guide means engagable with a portion of said body, said projection and said portion coacting to prevent removal of said retainer and guide means from said body.

10. The connector assembly according to claim 9 wherein said retainer and guide means having said projection thereon engages said corresponding connector assembly when said assemblies are mated preventing said projection from being disengaged from said portion of said body to lock said retainer and guide means within said body.

11. A connector assembly comprising a generally rectangular hollow body adapted to enclose and support a plurality of electrical terminals, said body having side walls and opposing open ends, said side walls and opposing ends cooperating to define a longitudinal axis of terminal insertion therein, at least one straight row of elongated terminal cavities aligned side by side joining said open ends, at least one straight wall section defining one wall of each cavity, said straight wall including deflectable means for engaging and retaining each of said terminals, said hollow body having a separate straight passage therein in transverse relation to said axis of terminal insertion and intersecting each of said cavities consecutively and passing through one of said side walls, and a removable terminal retainer means having an elongated leg slidably positioned in said passage and extending through said one side wall for interfering with movement of said terminals to prevent withdrawal of said terminals from said cavities, said terminal retainer means further including another leg positioned outside said cavities and against said straight wall section preventing said deflectable means from being deflected out of retaining engagement with each said terminals in said cavities.

* * * * *